US007707823B2

(12) United States Patent
Kawamura et al.

(10) Patent No.: US 7,707,823 B2
(45) Date of Patent: May 4, 2010

(54) EXHAUST PURIFICATION DEVICE FOR INTERNAL COMBUSTION ENGINE

(75) Inventors: Jyun Kawamura, Chita-gun (JP); Masakuni Yokoyama, Tokai (JP)

(73) Assignee: Denso Corporation, Kariya (JP)

( * ) Notice: Subject to any disclaimer, the term of this patent is extended or adjusted under 35 U.S.C. 154(b) by 529 days.

(21) Appl. No.: 11/806,734

(22) Filed: Jun. 4, 2007

(65) Prior Publication Data

US 2008/0028755 A1 Feb. 7, 2008

(30) Foreign Application Priority Data

Aug. 2, 2006 (JP) ..... 2006-210651

(51) Int. Cl.
*F01N 3/00* (2006.01)

(52) U.S. Cl. ..... 60/285; 60/274; 60/277; 60/286; 60/295; 60/297

(58) Field of Classification Search ..... 60/274, 60/276, 277, 285, 286, 295, 297, 301, 303
See application file for complete search history.

(56) References Cited

U.S. PATENT DOCUMENTS

| | | | | |
|---|---|---|---|---|
| 5,713,199 | A * | 2/1998 | Takeshima et al. | 60/276 |
| 5,715,679 | A * | 2/1998 | Asanuma et al. | 60/276 |
| 6,244,046 | B1 | 6/2001 | Yamashita | |
| 6,508,057 | B1 * | 1/2003 | Bouchez et al. | 60/286 |
| 6,568,178 | B2 * | 5/2003 | Hirota et al. | 60/297 |
| 6,718,753 | B2 * | 4/2004 | Bromberg et al. | 60/275 |
| 6,874,316 | B2 * | 4/2005 | Nakatani | 60/286 |
| 7,073,325 | B2 * | 7/2006 | Nakatani et al. | 60/295 |

* cited by examiner

*Primary Examiner*—Tu M Nguyen
(74) *Attorney, Agent, or Firm*—Nixon & Vanderhye PC

(57) ABSTRACT

An exhaust purification device is provided to selectively perform a combustion purge control and an exhaust addition purge control in response to an operation state of the internal combustion engine. The combustion purge control process is performed in the case where a NOx occlusion amount of a NOx catalyst is larger than or equal to a first threshold value, and the exhaust addition purge control process is performed in the case where the NOx occlusion amount of the NOx catalyst is larger than or equal to a second threshold value which is larger than the first threshold value.

10 Claims, 4 Drawing Sheets

EXHAUST PURIFICATION DEVICE FOR INTERNAL COMBUSTION ENGINE

CROSS REFERENCE TO RELATED APPLICATION

This application is based on a Japanese Patent Application No. 2006-210651 filed on Aug. 2, 2006, the disclosure of which is incorporated herein by reference.

FIELD OF THE INVENTION

The present invention relates to an exhaust purification device. The exhaust purification device can be suitably used for an internal combustion engine, for example.

BACKGROUND OF THE INVENTION

Generally, it is contemplated that an internal combustion engine where NOx (nitrogen oxides) is discharged due to combustion in cylinders is provided with an occlusion-reduction type NOx catalyst for occluding NOx in a lean state and reducing/releasing NOx in a rich state to purify NOx in exhaust gas.

Although the NOx catalyst occludes NOx when an air/fuel ratio of atmosphere of exhaust gas is lean, the NOx occlusion capacity of the NOx catalyst will become low with the NOx occlusion amount approaching the limit of the occlusion capacity.

Therefore, in order to reduce and remove NOx having been occluded by the NOx catalyst and restore the NOx purification capacity of the NOx catalyst, a process (rich purge control) for reducing and removing NOx having been occluded is performed. In this case, the air/fuel ratio of atmosphere of exhaust gas is set rich and a reducing agent such as HC or CO is supplied to the NOx catalyst when the NOx occlusion amount of the NOx catalyst reaches a threshold value.

Moreover, when the internal combustion engine has been used for the long term, sulfur in fuel is adsorbed to the NOx catalyst so that a sulfur poisoning occurs. Therefore, the purification capacity of the NOx catalyst will become significantly low. Thus, with reference to JP-2000-34946A, a technology is proposed to evaluate the deterioration of the purification capacity (catalyst deterioration evaluation) of the NOx catalyst in accordance with the performing of the rich purge control. Specifically, an oxygen concentration sensor is arranged at a downstream side of the NOx catalyst, to perform the catalyst deterioration evaluation based on the detection result of the oxygen concentration sensor when the rich purge control is performed.

That is, in the rich purge control, the air/fuel ratio of the downstream side of NOx catalyst is switched into rich when the reduction of NOx occluded by the NOx catalyst is finished. Therefore, the finish of the reduction of NOx is determined by detecting the air/fuel ratio via the oxygen concentration sensor. In this case, the switching timing of the air/fuel ratio via the oxygen concentration sensor becomes early when the NOx occlusion capacity becomes low, that is, when the NOx amount which can be occluded by the NOx catalyst decreases. Therefore, the deterioration degree of the purification capacity of the NOx catalyst can be estimated based on the time having elapsed until the air/fuel ratio is switched.

There are two methods for the rich purge control. The first method (combustion purge control) is setting the air/fuel ratio of atmosphere of exhaust gas to be rich to supply fuel which has not been combusted to the NOx catalyst as the reducing agent, by increasing the injection amount of fuel into the cylinders of the internal combustion engine to set the air/fuel ratio to be rich. The second method (exhaust addition purge control) is supplying fuel which has not been combusted to the NOx catalyst as the reducing agent, by adding fuel from a fuel supply valve (arranged at exhaust pipe) into the exhaust pipe.

The operation field of the engine where the combustion purge control can be used is limited to the field where the engine has a low RMP and a low load, because noise, vibration and the like in the case of switching a normal state will be caused and excessive smoke will be discharged in the combustion purge control. On the other hand, the exhaust addition purge control is useful, for example, in the case where the increase of the fuel injection amount to the internal combustion engine is not suitable. In this case, the combustion purge control and the exhaust addition purge control are selectively performed, in response to the operation state of the engine when the NOx occlusion amount (which is condition for starting rich purge control) reaches the threshold value.

Thus, in the case of the exhaust addition purge control, there may be an error in the result of the catalyst deterioration evaluation which is performed in accordance with the rich purge control, because only HC as the reducing agent becomes excessively dense at the NOx catalyst when fuel is directly added into the exhaust pipe through the fuel supply valve. Therefore, the catalyst deterioration evaluation is performed by only using the information of the combustion purge control.

However, in this case, the threshold value of the NOx occlusion amount which is the condition for starting the rich purge control is set across-the-board irrespectively of the combustion purge control/exhaust addition purge control. That is, the same threshold value is provided for the combustion purge control and the exhaust addition purge control. Therefore, it is difficult to sufficiently ensure the occasion where the combustion purge control is performed. Therefore, it is also difficult to sufficiently ensure the occasion where the catalyst deterioration evaluation is performed.

SUMMARY OF THE INVENTION

In view of the above-described disadvantages, it is an object of the present invention to provide an exhaust purification device, where a combustion purge control and an exhaust addition purge control are provided and an occasion of a catalyst deterioration evaluation is increased by an increase of an occasion of the combustion purge control.

According to one aspect of the present invention, an exhaust purification device for an internal combustion engine has a NOx catalyst which is arranged in an exhaust apparatus of the internal combustion engine, and a control unit for selectively performing a combustion purge control and an exhaust addition purge control in response to an operation state of the internal combustion engine. The NOx catalyst occludes NOx when an air/fuel ratio is lean, and reduces NOx having been occluded when the air/fuel ratio is rich so that the NOx is released. The combustion purge control is performed to set an amount of fuel supplied to the internal combustion engine in such a manner that the air/fuel ratio becomes rich and supply fuel for reduction to the NOx catalyst. The exhaust addition purge control is performed to add fuel for reduction into a part of the exhaust apparatus of an upstream side of exhaust gas with respect to the NOx catalyst. The control unit evaluates a deterioration degree of the NOx catalyst based on an amount of NOx which is reduced and released at the NOx catalyst by the combustion purge control. The control unit performs the combustion purge control in the case where a NOx occlusion amount of the NOx catalyst is larger than or equal to a first threshold value, and performs the exhaust addition purge control in the case where the NOx occlusion amount of the NOx catalyst is larger than or equal to a second threshold value which is larger than the first threshold value.

Therefore, the occasion of the combustion purge control is increased, so that the occasion of the catalyst deterioration evaluation is increased.

According to another aspect of the present invention, an exhaust purification method for an internal combustion engine includes a combustion purge control process for supplying fuel for reduction for a NOx catalyst arranged in an exhaust apparatus of the internal combustion engine by setting an amount of fuel supplied for the internal combustion engine in such a manner that an air/fuel ratio becomes rich, and an exhaust addition purge control process for adding fuel for reduction to a part of the exhaust apparatus of an upstream side of exhaust gas with respect to the NOx catalyst. The combustion purge control process and the exhaust addition purge control process are selectively performed in response to an operation state of the internal combustion engine. The combustion purge control process is performed in the case where a NOx occlusion amount of the NOx catalyst is larger than or equal to a first threshold value, and the exhaust addition purge control process is performed in the case where the NOx occlusion amount of the NOx catalyst is larger than or equal to a second threshold value which is larger than the first threshold value.

Thus, the occasion of the combustion purge control is increased.

Preferably, the exhaust purification method further includes an evaluation process for evaluating a deterioration degree of the NOx catalyst based on an amount of NOx which is reduced and released at the NOx catalyst by the combustion purge control process.

Therefore, the occasion of the catalyst deterioration evaluation is increased.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE EXAMPLED EMBODIMENT

Exampled Embodiment

An exhaust purification device according to an exampled embodiment of the present invention will be described with reference to FIGS. 1-5. The exhaust purification device can be suitably used for an internal combustion engine 1, for example.

Figure 1:
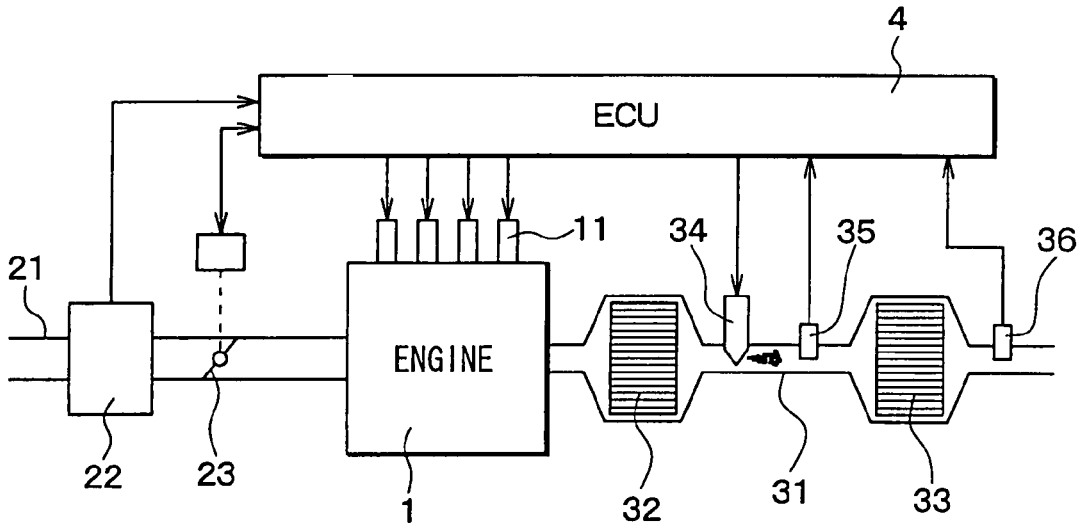
FIG. 1 is a block view showing a construction of an internal combustion engine where an exhaust purification device is suitably used according to an exampled embodiment of the present invention.

As shown in FIG. 1, the internal combustion engine 1 (e.g., internal combustion engine of compression ignition type) has an injector 11 which is attached to the body portion of the internal combustion engine 1. The internal combustion engine 1 is connected with a common rail (not shown) where high-pressure fuel is accumulated. The high-pressure fuel supplied from the common rail can be injected into a cylinder of the internal combustion engine 1.

An intake pipe 21 of the internal combustion engine 1 is provided with an air flow meter 22 for detecting fresh air amount supplied to the internal combustion engine 1, and an intake throttle 23 which is arranged at the downstream side of air with respect to the air flow meter 22 to adjust the fresh air amount.

A capture apparatus 32 for capturing (collecting) exhaust particulates in exhaust gas of the internal combustion engine 1 is arranged in an exhaust pipe 31 of the internal combustion engine 1. A NOx catalyst 33 is provided in the exhaust pipe 31 and positioned at the downstream side of exhaust gas with respect to the capture apparatus 32, to occlude NOx in exhaust gas when the air/fuel Ratio is lean. In this case, the NOx catalyst 33 reduces and releases NOx having been occluded when the air/fuel Ratio is rich.

A fuel supply valve 34, through which fuel is injected to the exhaust pipe 31 to supply the fuel as a reducing agent for the NOx catalyst 33, is attached to the exhaust pipe 31 and positioned at the downstream side with respect to the capture apparatus 32 and at the upstream side with respect to the NOx catalyst 33. The fuel supply valve 34 can be constructed in such a manner that a needle of the fuel supply valve 34 for opening/closing an injection hole of the fuel supply valve 34 is driven by an electromagnetic solenoid, for example.

A first A/F sensor 35 for detecting the air/fuel ratio of the exhaust gas flowing into the NOx catalyst 33 is arranged at the exhaust pipe 31 and positioned at the downstream side with respect to the fuel supply valve 34 and at the upstream side with respect to the NOx catalyst 33. A second A/F sensor 36 for detecting the air/fuel ratio of the exhaust gas having passed through the NOx catalyst 33 is arranged at the exhaust pipe 31 and positioned at the downstream side with respect to the NOx catalyst 33.

The outputs of the sensors 35 and 36 are provided for a control unit 4 (e.g., ECU) which can be constructed of a microcomputer having a CPU, a ROM, a RAM, and an EEPROM (not shown) to process a predetermined calculation based on signals from the sensors 35 and 36 or the like. Thus, operations of the components of the internal combustion engine 1 can be controlled by the ECU 4.

Specifically, the ECU 4 can calculate a command injection amount based on the load and revolution (e.g., RPM) of the internal combustion engine 1. Moreover, the ECU 4 calculates an injection amount command value corresponding to the injector driving time, based on the command injection amount, and outputs a signal of the injection amount command value to the internal combustion engine 1. Furthermore, the 4 controls the intake throttle 23 and 34 and the like based on the calculation result.

Next, a rich purge control process and a catalyst deterioration evaluation process executed by the ECU 4 will be described.

Figure 2:
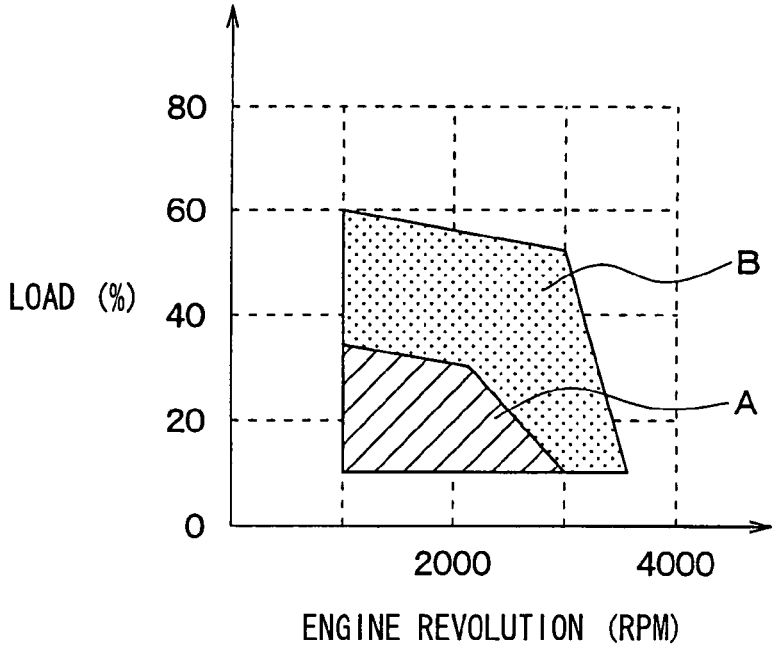
FIG. 2 is a graph showing a range A where a combustion purge control is performed and a range B where an exhaust addition purge control is performed according to the exampled embodiment.

FIG. 2 is graph showing a range A (combustion purge range) where a combustion purge control is performed and a range B (exhaust addition purge range) where an exhaust addition purge control is performed. The graph can be memorized in the ROM of the ECU 4, for example. In FIG. 2, the longitudinal axis represents the load of the internal combustion engine 1, and the lateral axis represents the revolution of the internal combustion engine 1. The combustion purge range A where the load and revolution are low is indicated by a range filled with oblique line. The exhaust addition purge range B where the load and revolution are intermediate is indicated by a range filled with dot. In this case, the rich purge control is prohibited in a range where the load and revolution are high.

Figure 3:
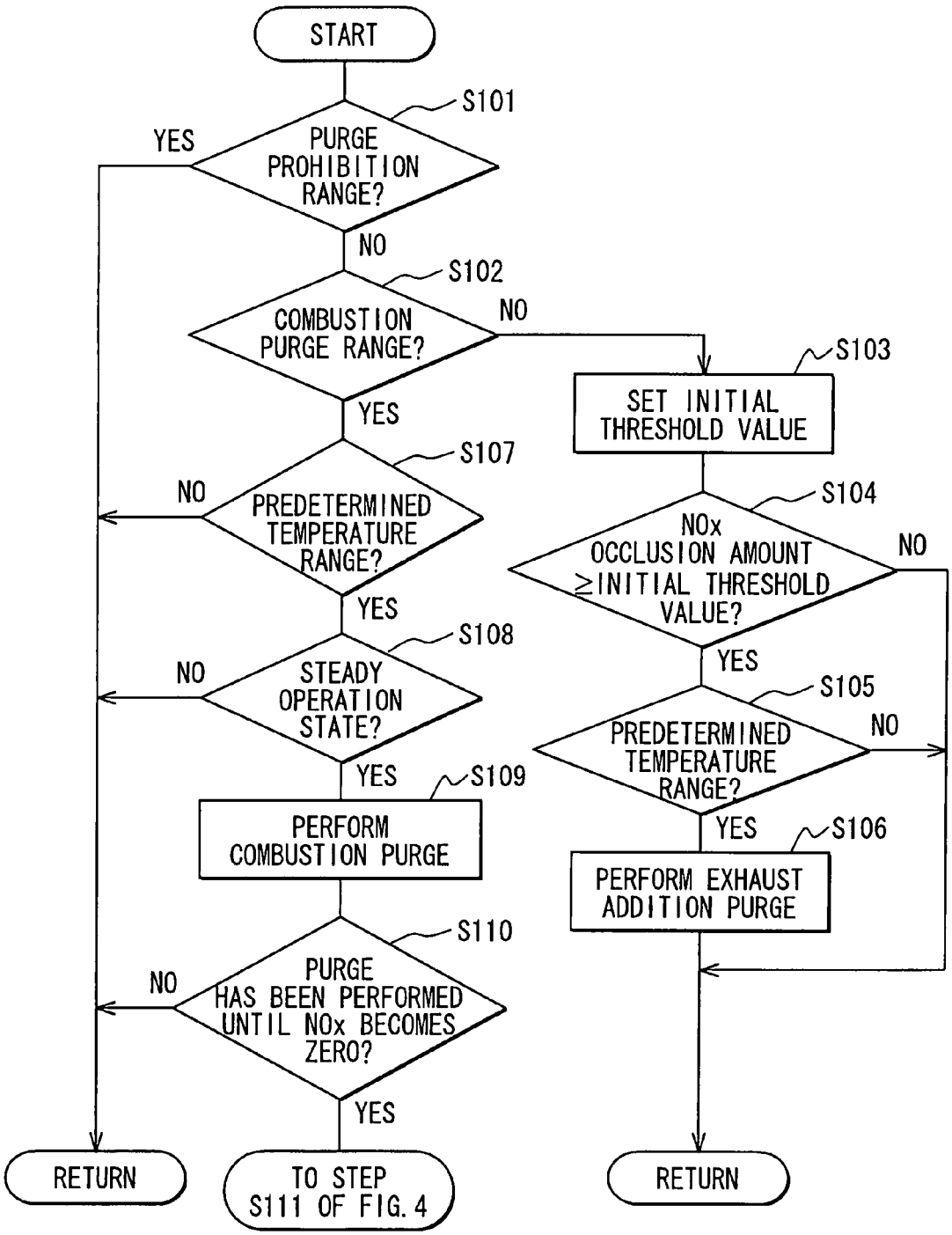
FIG. 3 is a flow chart showing a rich purge control process and a catalyst deterioration evaluation process performed by an ECU according to the exampled embodiment.
Figure 4:
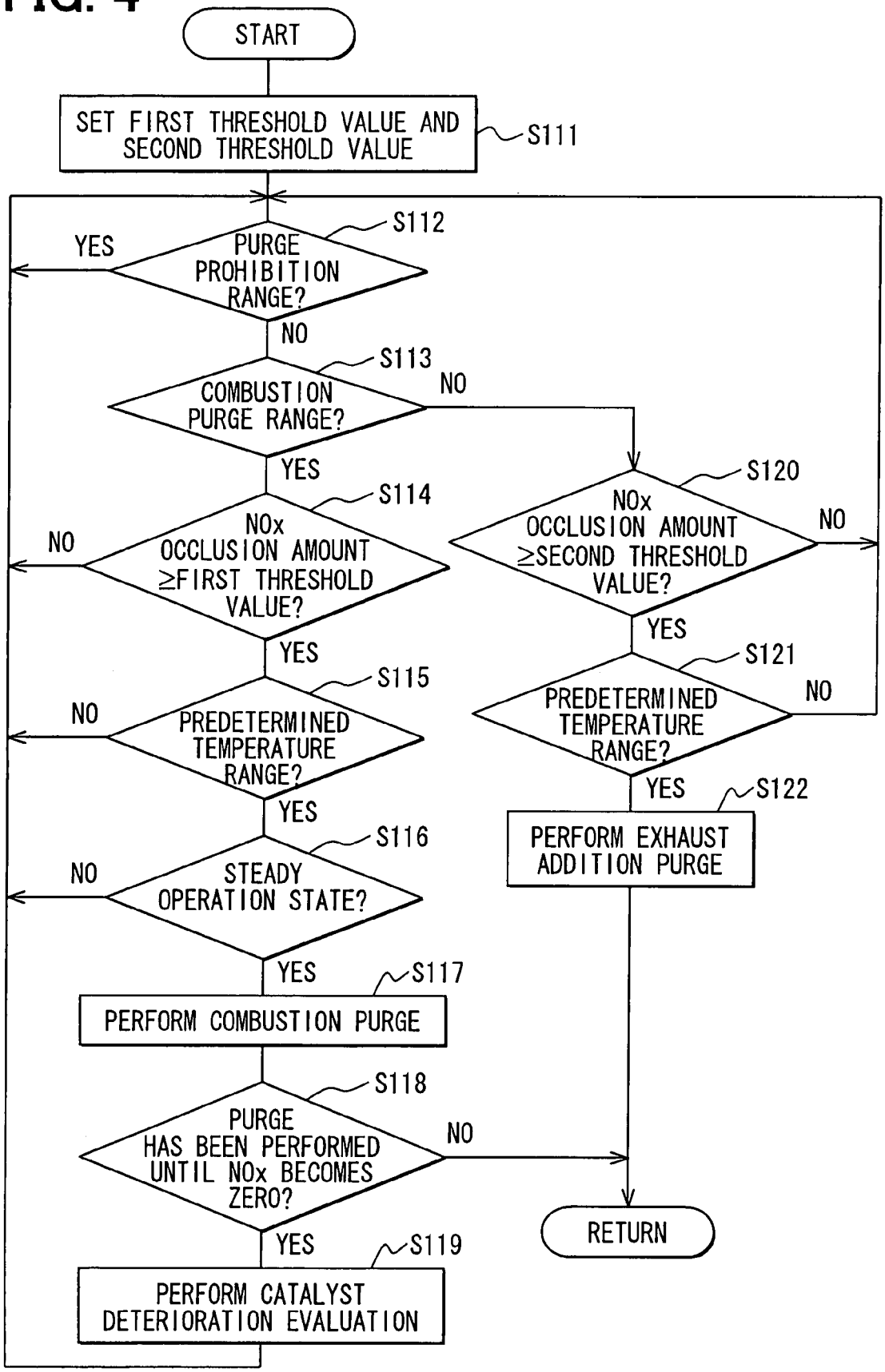
FIG. 4 is a flow chart showing the rich purge control process and the catalyst deterioration evaluation process performed by the ECU according to the exampled embodiment.
Figure 5:
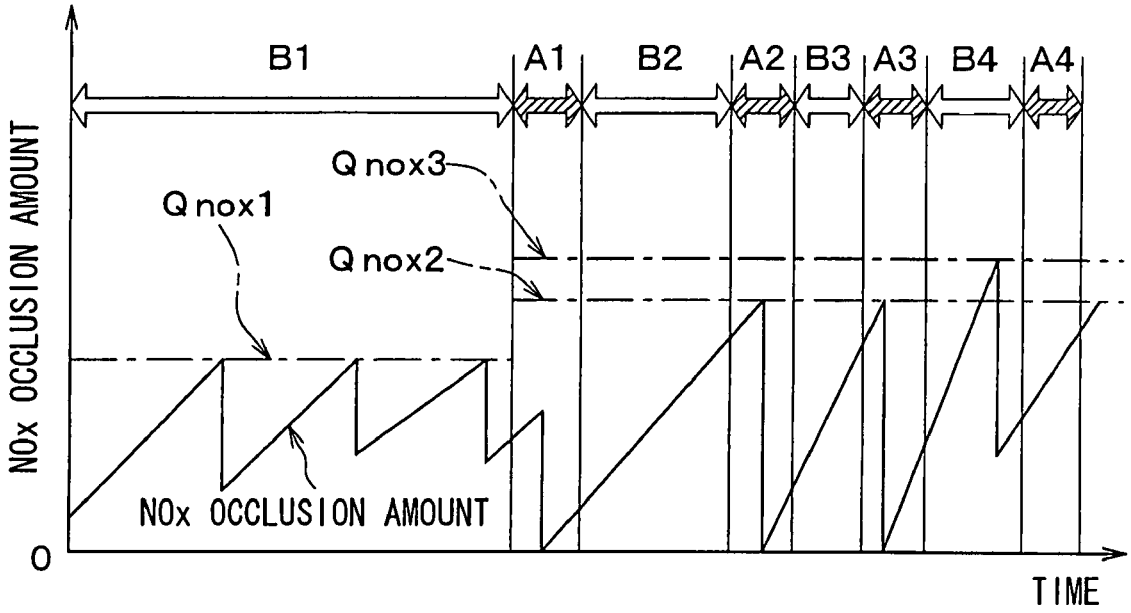
FIG. 5 is a time chart showing an operation example of the processes of FIGS. 3 and 4 according to the exampled embodiment.

FIGS. 3 and 4 are flow charts showing the rich purge process and the catalyst deterioration evaluation process performed by the ECU 4. FIG. 5 is a time chart showing operations of the processes of FIGS. 3 and 4. In FIG. 5, ranges A1-A4 correspond to the combustion purge range A, and ranges B1-B4 correspond to the exhaust addition purge range B.

The processes shown in FIGS. 3 and 4 can be started when power is supplied to the ECU 4 (e.g., when the internal combustion engine 1 is actuated by operation of a key switch), and be ended when the power supply for the ECU 4 is ceased (e.g., when internal combustion engine 1 is stopped by operation of key switch).

As shown in FIG. 3, at first, at step S101, it is determined whether or not the operation state of the internal combustion engine 1 is in the range (purge prohibition range) where the rich purge control is prohibited. Specifically, the determining is performed with reference to the map shown in FIG. 2 memorized in the ROM of the ECU 4, based on the load and revolution of the internal combustion engine 1. Thus, when it is determined that the operation state of the internal combustion engine 1 is in the range where the rich purge control is prohibited (that is, determining result of step S101 is "YES"), the process shown in FIG. 3 will be repeated from step S101.

When it is determined that the operation state of the internal combustion engine 1 is in the range where the rich purge control is not prohibited (that is, determining result of step S101 is "NO"), step S102 will be performed. In the case where the predetermined condition is satisfied, the rich purge control will performed.

At Step S102, it is determined whether or not the operation state of the internal combustion engine 1 is in the combustion purge range A. Specifically, the determining is performed with reference to the map shown in FIG. 2, based on the load and revolution of the internal combustion engine 1. Thus, when it is determined that the operation state of the internal combustion engine 1 is not in the combustion purge range A (i.e., determining result of step S102 is "NO"), that is, when the operation state of the internal combustion engine 1 is in the exhaust addition purge range B, step S103 will be performed.

At step S103, an initial purge threshold value Qnox1 which is the condition for starting the exhaust addition purge control is set, with reference to FIG. 5. Then, at step S104, it is determined whether or not the NOx occlusion amount of the NOx catalyst 33 is larger than or equal to the initial purge threshold value Qnox1.

When the NOx occlusion amount of the NOx catalyst 33 is larger than or equal to the initial purge threshold value Qnox1 (that is, determining result of step S104 is "YES"), step S105 will be performed.

At step S105, it is determined whether or not the temperature of the NOx catalyst 33 detected by a temperature sensor (not shown) is in a temperature range (e.g., substantially from 200° C. to 450° C.) where the reduction of NOx is capable. When it is determined that the temperature of the NOx catalyst 33 is in the temperature range (that is, determining result of step S105 is "YES"), step S106 will be performed to perform the exhaust addition purge control process (referring to range B1 in FIG. 5).

At step S104, the NOx occlusion amount of the NOx catalyst 33 can be calculated based on the concentration of NOx, the flow amount of exhaust gas, and the purification rate of the NOx catalyst 33. Alternatively, the NOx occlusion amount of the NOx catalyst 33 can be also estimated based on the operation period of the internal combustion engine 1 from the finish of the preceding rich purge control to the current time.

At step S106, the air/fuel ratio of the exhaust gas flowing to the NOx catalyst 33 is set rich, by opening the fuel supply valve 34 and injecting the fuel into the exhaust pipe 31. Thus, NOx having been occluded by the NOx catalyst 33 is reduced and removed.

In the case of the exhaust addition purge control, because whether or not the NOx occlusion amount of the NOx catalyst 33 has become zero is unknown, the process shown in FIG. 3 will be repeated from step S101 after step S106 is finished.

Moreover, in the case where the process condition of the exhaust addition purge control is not satisfied (that is, in the case where determining result of step S104 or step S105 is "NO"), the process shown in FIG. 3 will be also repeated from step S101.

On the other hand, in the case where the determining result of step S102 is "YES", that is, in the case where the operation state of the internal combustion engine 1 is in the combustion purge range A, step S107 will be performed. At step S107, it is determined whether or not the temperature of the NOx catalyst 33 is in the temperature rang where the reduction of NOx is capable.

In the case where it is determined that the temperature of the NOx catalyst 33 is in the temperature rang where the reduction of NOx is capable (that is, determining result of step S107 is "YES"), step S108 will be performed.

At step S108, it is determined whether or not the internal combustion engine 1 is in a steady operation state. In the case where it is determined that the internal combustion engine 1 is in the steady operation state (that is, determining result of step S108 is "YES"), step S109 will be performed to execute the combustion purge control (with reference to range A1 shown in FIG. 5).

At step S108, in the case where the state that the load and revolution of the internal combustion engine 1 keep constant continues for a period which is larger than or equal to a predetermined value (for example, which is larger than 1 sec and smaller than 2 secs), it is determined that the internal combustion engine 1 is in the steady operation state.

Specifically, at step S109, the air/fuel ratio of the exhaust gas flowing to the NOx catalyst 33 is set rich by increasing the injection amount of fuel into the cylinder of the internal combustion engine 1, so that NOx having been occluded by the NOx catalyst 33 is reduced and removed. That is, the combustion purge control at step S109 is performed irrespectively of the occlusion amount of NOx of the NOx catalyst 33.

Thereafter, at step S110, it is determined whether or not the combustion purge control has been performed until the NOx occlusion amount of the NOx catalyst 33 becomes about zero. Specifically, the air/fuel ratio at the downstream side of the NOx catalyst 33 will be switched into rich, when the reduction of occluded NOx is finished in the combustion purge control process. Therefore, it is determined that the combustion purge control has been performed until the NOx occlusion amount of the NOx catalyst 33 becomes about zero, in the case where the combustion purge control has been performed until the air/fuel ration detected by the second A/F sensor 36 becomes a value of the rich side.

Thus, in the case where the combustion purge control has been performed until the NOx occlusion amount of the NOx catalyst 33 becomes about zero (i.e., determining result of step S110 is "YES"), that is, in the case where once the NOx occlusion amount of the NOx catalyst 33 is reset to be substantially equal to zero, the NOx occlusion amount of the NOx catalyst 33 after the resetting can be estimated so that the catalyst deterioration evaluation process can be performed.

Thus, in the case where the determining result of step S110 is "YES", step 111 shown in FIG. 4 will be performed. Then, the catalyst deterioration evaluation will be performed in the case where the predetermined conditions are satisfied.

On the other hand, in the case where the NOx occlusion amount of the NOx catalyst 33 is not reset to be substantially equal to zero (that is, determining result of step S110 is "NO"), it is difficult to estimate the NOx occlusion amount of the NOx catalyst 33 so that the catalyst deterioration evaluation cannot be performed with a satisfied accuracy. Therefore, the process shown in FIG. 3 will be repeated from step S101. Moreover, in the case where the process condition of the combustion purge control is not satisfied, that is, in the case where the determining result of step S107 or step S108 is "NO", the process shown in FIG. 3 will be also repeated from step S101.

Next, the process after it is determined that the combustion purge control has been performed until the NOx occlusion amount of the NOx catalyst 33 becomes about zero (i.e., determining result of step S110 is "YES") will be described with reference to FIG. 4.

At first, at step S111, a combustion purge threshold value Gnox2 (first threshold value) for a start of the combustion purge control is set, and an exhaust addition purge threshold value Gnox3 (second threshold value) for a start of the exhaust addition purge control is set (with reference to FIG. 5). In this case, the three threshold values are set to be Gnox1<Gnox2<Gnox3.

Then, step S112 will be performed. At step S112, it is determined whether or not the operation state of the internal combustion engine 1 is in the range where the rich purge control is prohibited. In the case where it is determined that the operation state of the internal combustion engine 1 is in the range where the rich purge control is prohibited (that is, determining result of step S112 is "YES"), step S112 will be repeated.

On the other hand, in the case where it is determined that the operation state of the internal combustion engine 1 is not in the range where the rich purge control is prohibited (that is, determining result of step S112 is "NO"), step S113 will be repeated. The rich purge control will be performed in the case where the predetermined conditions are satisfied.

At step S113, it is determined whether or not the operation state of the internal combustion engine 1 is in the combustion purge range A. In the case where it is determined that the operation state of the internal combustion engine 1 is in the combustion purge range A (that is, determining result of step S113 is "YES"), step S114 will be performed.

At step S114, it is determined whether or not the NOx occlusion amount of the NOx catalyst 33 is larger than or equal to the combustion purge threshold value Qnox2. In the case where the NOx occlusion amount of the NOx catalyst 33 is larger than or equal to the combustion threshold value Qnox2 (that is, determining result of step S114 is "YES"), it is further determined at step S115 whether or not the temperature of the NOx catalyst 33 is in the predetermined range where the reduction of NOx is capable.

In the case where the temperature of the NOx catalyst 33 is in the predetermined range where the reduction of NOx is capable (that is, determining result of step S115 is "YES"), it is further determined at step S116 whether or not the internal combustion engine 1 is the steady operation state.

In the case where it is determined that the internal combustion engine 1 is the steady operation state (that is, determining result of step S116 is "YES"), S117 will be performed so that the combustion purge control will be performed (referring to range A2 and A3 shown in FIG. 5).

On the other hand, when the determining result of step S114, or S115 or S116 is "NO" (that is, processing condition of combustion purge control are not satisfied), the process shown in FIG. 4 will be repeated from step S112.

After step S117, step S118 will be performed to determine whether or not the combustion purge control has been performed until the occlusion amount of the NOx catalyst 33 becomes about zero.

In the case where it is determined that the combustion purge control has been performed until the occlusion amount of the NOx catalyst 33 becomes about zero (that is, determining result of step S118 is "YES"), the catalyst deterioration evaluation will be performed at step S119.

In this case, the catalyst deterioration evaluation is performed to determine the deterioration degree of the catalyst, by comparing an expected reduction amount of NOx (for example, which can be calculated based on property of catalyst before deterioration) with the reduction amount of NOx which has been practically reduced via the combustion purge control.

After the catalyst deterioration evaluation at step S119 is finished, the process shown in FIG. 4 will be repeated from step S112. In the case where it is determined at step S118 that the NOx occlusion amount of the NOx catalyst 33 is not reset to be about zero (that is, determining result of step S118 is "NO"), the process will be repeated from step S101 shown in FIG. 3.

On the other hand, in the case where it is determined at step S113 that the operation state of the internal combustion engine 1 is not in the combustion purge range A, that is, that the operation state of the internal combustion engine 1 is in the exhaust addition purge range B, step S120 will be performed.

At step S120, it is determined whether or not the NOx occlusion amount of the NOx catalyst 33 is larger than or equal to the exhaust addition purge threshold value Qnox3. In the case where the NOx occlusion amount of the NOx catalyst 33 is larger than or equal to the exhaust addition purge threshold value Qnox3 (that is, determining result of step S120 is "YES"), step S121 will be performed.

At step S121, it is determined whether or not the temperature of the NOx catalyst 33 is in the predetermined range where the reduction of NOx is capable. In the case where the temperature of the NOx catalyst 33 is in the predetermined range (that is, determining result of step S121 is "YES"), the exhaust addition purge control will be performed at step S122 (referring to range B4 shown in FIG. 5).

In this case, because whether or not the NOx occlusion amount of the NOx catalyst 33 has been reset to be substantially equal to zero is unknown, the process will be repeated from step S101 shown in FIG. 3 after step S122 is finished. Moreover, in the case where the processing condition of the exhaust addition purge control is not satisfied (that is, determining result of step S120 and S121 is "NO"), the process shown in FIG. 4 will be repeated from step S112.

According to this embodiment, because the combustion purge threshold value Qnox2 is set smaller than the exhaust addition purge threshold value Qnox3, the occasion of the combustion purge control is increased. Therefore, the occasion of the catalyst deterioration evaluation is increased.

Moreover, in at least one of following two cases, the combustion purge control is performed (step S109) irrespectively of the NOx occlusion amount of the NOx catalyst 33, when the internal combustion engine 1 is in the predetermined operation state where the combustion purge control is selected (that is, determining result of step S102 is "YES"). The first case is that the combustion purge control is ceased before the NOx occlusion amount of the NOx catalyst 33 becomes zero, immediately after the startup of the internal combustion engine 1 (that is, in the case where the determining result of step S110 or S118 is "NO"). The second case is immediately after the finish of the exhaust addition purge control (step S106 and step S122).

Therefore, the NOx occlusion amount of the NOx catalyst 33 can be reset to be about zero at an early occasion, so that the catalyst deterioration evaluation can be performed earlier with an improved accuracy.

What is claimed is:

1. An exhaust purification method for an internal combustion engine, comprising:

a combustion purge control process for supplying fuel for reduction for a NOx catalyst arranged in an exhaust apparatus of the internal combustion engine by setting an amount of fuel supplied for the internal combustion engine in such a manner that an air/fuel ratio becomes rich; and an exhaust addition purge control process for adding fuel for reduction to a part of the exhaust apparatus of an upstream side of exhaust gas with respect to the NOx catalyst, wherein:

the combustion purge control process and the exhaust addition purge control process are selectively performed in response to an operation state of the internal combustion engine; and the combustion purge control process is performed in the case where a NOx occlusion amount of the NOx catalyst is larger than or equal to a first threshold value, and the exhaust addition purge control process is performed in the case where the NOx occlusion amount of the NOx catalyst is larger than or equal to a second threshold value which is larger than the first threshold value.

2. The exhaust purification method according to claim 1, wherein in at least one of a first case and a second case, the combustion purge control process is performed irrespectively of the NOx occlusion amount of the NOx catalyst, when the internal combustion engine is in a predetermined operation state where the combustion purge control process is selected, the first case being that the combustion purge control process is ceased before the NOx occlusion amount of the NOx catalyst substantially becomes zero, immediately after startup of the internal combustion engine, the second case being immediately after finish of the exhaust addition purge control process.

3. The exhaust purification method according to claim 1, further comprising an evaluation process for evaluating a deterioration degree of the NOx catalyst based on an amount of NOx which is reduced and released at the NOx catalyst by the combustion purge control process.

4. The exhaust purification method according to claim 3, wherein in at least one of a first case and a second case, the combustion purge control process is performed irrespectively of the NOx occlusion amount of the NOx catalyst, when the internal combustion engine is in a predetermined operation state where the combustion purge control process is selected, the first case being that the combustion purge control process is ceased before the NOx occlusion amount of the NOx catalyst substantially becomes zero, immediately after startup of the internal combustion engine, the second case being immediately after finish of the exhaust addition purge control process.

5. The exhaust purification method according to claim 3, wherein the evaluation process is performed in the case where the combustion purge control process has been performed until the NOx occlusion amount of the NOx catalyst substantially becomes zero.

6. The exhaust purification method according to claim 5, wherein in at least one of a first case and a second case, the combustion purge control process is performed irrespectively of the NOx occlusion amount of the NOx catalyst, when the internal combustion engine is in a predetermined operation state where the combustion purge control process is selected, the first case being that the combustion purge control process is ceased before the NOx occlusion amount of the NOx catalyst substantially becomes zero, immediately after startup of the internal combustion engine, the second case being immediately after finish of the exhaust addition purge control process.

7. An exhaust purification device for an internal combustion engine, comprising:

a NOx catalyst which is arranged in an exhaust apparatus of the internal combustion engine, the NOx catalyst occluding NOx when an air/fuel ratio is lean and reducing NOx having been occluded when the air/fuel ratio is rich so that the NOx is released; and a control unit for selectively performing a combustion purge control and an exhaust addition purge control in response to an operation state of the internal combustion engine, wherein:

the combustion purge control is performed to supply fuel for reduction for the NOx catalyst by setting an amount of fuel supplied for the internal combustion engine in such a manner that the air/fuel ratio becomes rich;

the exhaust addition purge control is performed to add fuel for reduction to a part of the exhaust apparatus of an upstream side of exhaust gas with respect to the NOx catalyst;

the control unit evaluates a deterioration degree of the NOx catalyst based on an amount of NOx which is reduced and released at the NOx catalyst by the combustion purge control;

the control unit performs the combustion purge control in the case where a NOx occlusion amount of the NOx catalyst is larger than or equal to a first threshold value, and performs the exhaust addition purge control in the case where the NOx occlusion amount of the NOx catalyst is larger than or equal to a second threshold value, the first threshold value being smaller than the second threshold value.

8. The exhaust purification device according to claim 7, wherein in at least one of a first case and a second case, the control unit performs the combustion purge control irrespectively of the NOx occlusion amount of the NOx catalyst, when the internal combustion engine is in a predetermined operation state where the combustion purge control is selected, the first case being that the combustion purge control is ceased before the NOx occlusion amount of the NOx catalyst substantially becomes zero, immediately after startup of the internal combustion engine, the second case being immediately after finish of the exhaust addition purge control.

9. The exhaust purification device according to claim 7, wherein the control unit evaluates the deterioration degree of the NOx catalyst in the case where the combustion purge control has been processed until the NOx occlusion amount of the NOx catalyst substantially becomes zero.

10. The exhaust purification device according to claim 9, wherein in at least one of a first case and a second case, the control unit performs the combustion purge control irrespectively of the NOx occlusion amount of the NOx catalyst, when the internal combustion engine is in a predetermined operation state where the combustion purge control is selected, the first case being that the combustion purge control is ceased before the NOx occlusion amount of the NOx catalyst substantially becomes zero, immediately after startup of the internal combustion engine, the second case being immediately after finish of the exhaust addition purge control.

* * * * *